US006199500B1

(12) United States Patent
Børseth et al.

(10) Patent No.: US 6,199,500 B1
(45) Date of Patent: Mar. 13, 2001

(54) DEVICE BY SHIP FOR PRODUCTION/TEST PRODUCTION OF OIL/GAS FROM A FIELD BELOW SEABED LEVEL

(75) Inventors: Knut E. Børseth, Tårnåsen; Arne Smedal, Færvik, both of (NO)

(73) Assignees: Hitec Systems AS, Stavanger; PGS Offshore Technology AS, Lysaker, both of (NO)

( * ) Notice: Subject to any disclaimer, the term of this patent is extended or adjusted under 35 U.S.C. 154(b) by 0 days.

(21) Appl. No.: 09/381,080

(22) PCT Filed: Mar. 10, 1998

(86) PCT No.: PCT/NO98/00079

§ 371 Date: Nov. 12, 1999

§ 102(e) Date: Nov. 12, 1999

(87) PCT Pub. No.: WO98/41444

PCT Pub. Date: Sep. 24, 1998

(30) Foreign Application Priority Data

Mar. 14, 1997 (NO) ..... 971176

(51) Int. Cl.[7] ..... B63B 21/00
(52) U.S. Cl. ..... 114/230.12; 441/5
(58) Field of Search ..... 441/3–5; 114/230.1, 114/230.12

(56) References Cited

U.S. PATENT DOCUMENTS 5,065,689 * 11/1991 Krogstad ..... 441/5
5,279,245 * 1/1994 Braud et al. ..... 114/230.12
5,540,607 7/1996 Breivik et al. .

FOREIGN PATENT DOCUMENTS 831 023 3/1998 (EP) .
2 285 028 6/1995 (GB) .
176752 5/1995 (NO) .
93/06001 4/1993 (WO) .
93/24733 12/1993 (WO) .
94/02351 2/1994 (WO) .

* cited by examiner

*Primary Examiner*—Stephen Avila
(74) *Attorney, Agent, or Firm*—Andrus, Sceales, Starke & Sawall, LLP

(57) ABSTRACT

To permit use of a ship as production ship, among other things in conjunction with a so-called STL-buoy (30) and in test production without a buoy (30), and in which the ship (10) is formed with a bottom recess (12) for the reception of the buoy (30) in a mutually pivotal manner, there has been formed, immediately above said bottom recess (12), a vertically oriented cavity (14) in the ship's hull. In this cavity (14) is pivotally supported a sleeve-shaped turret (16) which is configured with at least one through bore, channel or other passage for passing pipelines (24, 24'), pipeline portions (38, 38'), or the like, which may be connected at the one end via a swivel device (22) to one or more pipes or the like (26) fixed in the vessel. The sleeve-shaped turret (16) works alone during test production, but is connected to the buoy (30) so that together they form a turret (16, 30) in regular production.

2 Claims, 3 Drawing Sheets

DEVICE BY SHIP FOR PRODUCTION/TEST PRODUCTION OF OIL/GAS FROM A FIELD BELOW SEABED LEVEL

BACKGROUND OF THE INVENTION

The invention relates to a ship of the kind used in the production or test production respectively in connection with exploitation of small fields of oil/gas below seabed level, whereby the production may take place by means of a so-called STL-buoy or corresponding device formed with a preferably upward tapering, conical, first turret that the ship is arranged to receive by a lower, complementarily formed recess.

Thus, it is known to produce oil from ships via such a buoy, which is a buoyancy body held in a suitably submerged condition by means of mooring hawsers anchored to the seabed. Internally the buoy is formed with at least one through channel or bore connected to a riser constituted by tubing leading to one or more subsea wells.

A ship of the kind mentioned is a production ship which is only adapted to co-operate with such a buoy, and for this purpose the ship is provided with a swivel device interconnecting the pipeline outlet(s) of the buoy and at least one stationary pipeline aboard the ship, leading to a cargo compartment for oil. Such production ships are not suitable for application in test production of wells, because of, among other things, said swivel device is only working in connection with the buoy and not in connection with so-called test tubings. Such test tubings are not arranged to be connected to the pipeline outlet(s) of the buoy through the swivel device, but have a free vertical extension from a rig aboard the ship to the buoy to be tested. When a production ship is pivotally connected to a buoy via said swivel device, the vertical axis of rotation of the buoy will form the axis of rotation of the ship. In this case the buoy constitutes the "turret" of the ship. When such a ship is to be used in test production, said ship will lack an essentially stationary turret about which it may turn dependent on wind, sea and water currents.

According to the present invention, there has been aimed at providing a ship, which, through relatively simple structural modifications, will be well suited for production in connection with buoy as well as for test production. In this way a more flexible use of the ship is achieved, the ship thus to be used as production ship in connection with a buoy in one particular place in one period, and then, in another period and in another place, to be used as test production ship.

According to the invention this has been achieved by means of a combination vessel in the form of a production/test production ship which distinguishes itself by the features defined in the characterizing part of the claims.

According to the invention, immediately above its downward open recess for the reception of a buoy, this combination vessel is configured with a preferably through opening extending vertically upwards, in which is arranged a (second) turret which is free to rotate in the ship about a vertical axis, about which the ship may pivot depending on wind, sea and currents when it is used in connection with test production. This second turret, the buoy is called the "first" turret, serves for passing test tubing, which is connected aboard the ship, through a swivel device, to at least one stationary pipeline which may lead to a cargo compartment for oil. The test tubings mainly do not move during the test production operations, while the ship may turn freely about the vertical axis of the second turret. When a production/test production ship provided with a turret (second turret) of its own is to be used as a production ship in connection with a buoy, the latter—the first turret—is securely connected to the second turret, at the same time as the channel(s)/bore(s) of the first turret is(are) connected to the pipeline(s) of the second turret. In these connecting operations it is an advantage if the second turret is arranged liftable/lowerable and may be brought to adopt the lifted position during at least the preliminary work, as the actual connecting takes place when the first turret (the buoy) is brought into place in the downward open recess of the ship, and the second turret has been lowered into its second position.

Thus, the ship has two functions, namely (a) as a test production ship when exclusively the second turret forms the axis of rotation of the ship and the through passage for pipeline(s), and (b) as a production ship when the second turret is securely connected to an underlying buoy forming the first turret, and in which the connected first and second turrets together form the axis of rotation of the ship and the passage for said pipeline(s) extending down into the sea. In both cases the further transport of oil takes place by means of a stationary pipeline(s) via said swivel device, which will normally be positioned on top of the second turret.

When the second turret is used in test or trial production, the ship is held in position by so-called dynamic positioning, i.e. without the use of anchor hawsers for anchoring to the seabed.

Objects, advantages and features of the present invention will appear from the following description in conjunction with a non-limiting example of a preferred embodiment of a production/test production ship configured in accordance with the invention.

BRIEF DESCRIPTION OF THE SEVERAL VIEWS OF THE DRAWING

Reference is made to the enclosed schematic drawings of a combination vessel according to the invention, which for the greater part is shown by a section through the vertical, longitudinal central plane, without the cuts being further defined or hatched, the other components, equipment and hull portions being shown in side view, while the rig structure (right above the turret of the ship) has been omitted for the sake of clarity, and in which.

DETAILED DESCRIPTION OF THE INVENTION

Figure 1:
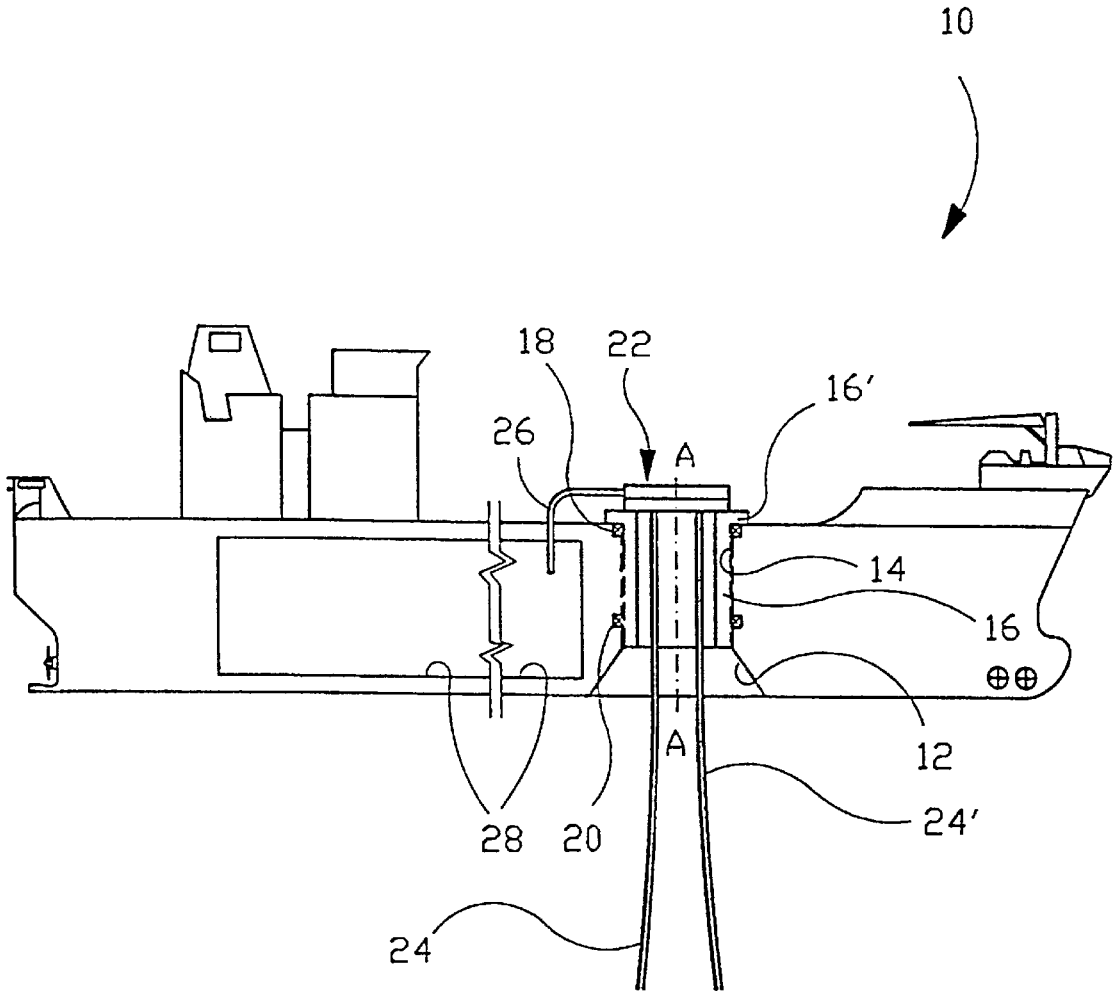
FIG. 1 shows the ship according to the invention in a first operating condition, in which it serves as a test production ship and thus does not co-operate with a buoy.

Reference is first made to FIG. 1, which shows the ship according to the invention used as a test production ship. In a manner known in itself, the ship, generally defined by the reference numeral 10, is formed in a bottom portion with a conical recess 12 widening downwards. As will be explained later, this bottom recess 12 is formed essentially complementary to a so-called STL-buoy or corresponding device.

Above this upward conically tapering bottom recess 12 there is formed in the ship's hull, according to the present invention, an opening or cylindrical cavity 14 coaxial with the bottom recess 12, the common axis being defined by A—A.

According to the invention, in said cylindrical cavity 14 is pivotally supported a turret 16, which in this description and claims are referred to as the "second" turret; this because said buoy in conventional technique is known for its function as a "turret", about which the production ship turns via a swivel device aboard the ship. As the ship according to the invention also may work as a production ship in connection with such a buoy, which then serves as a turret, it comes naturally in this connection to refer to the buoy as the "first" turret.

The second turret 16 is pivotally supported in the cylindrical cavity 14 of the ship's hull by means of bearings 18 and 20, in which the upper bearing 18 may be a combined axial/radial bearing with the axial bearing uppermost for supporting an outward extending annular flange 16' on the second turret 16. The lower bearing 20 is a radial bearing. The ship is provided with a not shown rig structure above the turret 16, which is used during test production among other things.

On top of the outward extending, annular flange 16' of the second turret 16 is arranged a swivel device 22 which permits relative movement of the down-hanging test tubings 24, 24' which follow the movement of the second turret 16, and a stationary pipeline 26 which leads to a cargo compartment 28 for oil.

Figure 2:
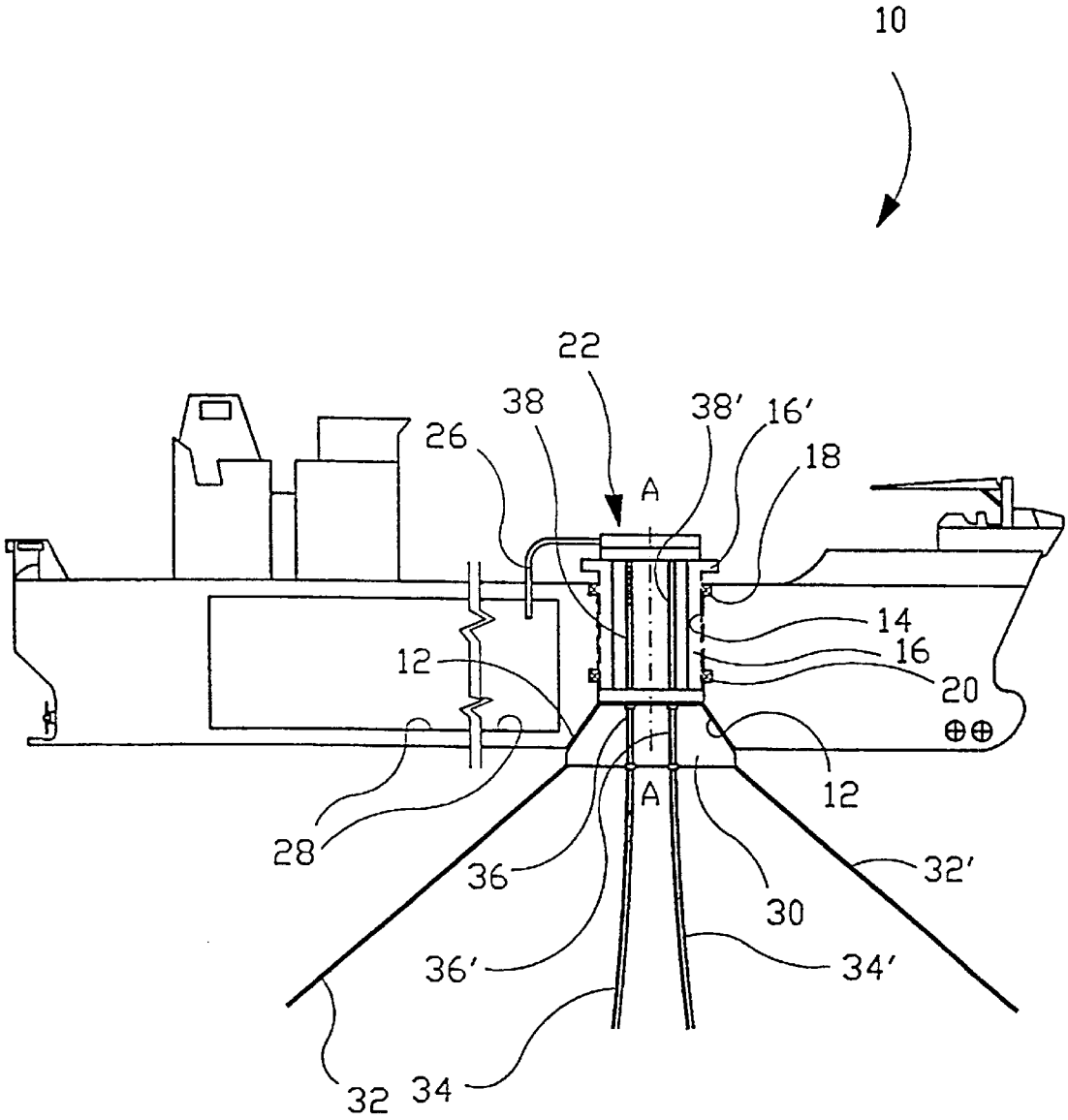
FIG. 2 shows the ship according to the invention adopting a second operating condition, the figure illustrating a buoy (first turret) brought into engagement with the downward open bottom recess of the ship, the ship's own turret (second turret) being lifted into its upper position for this purpose.
Figure 3:
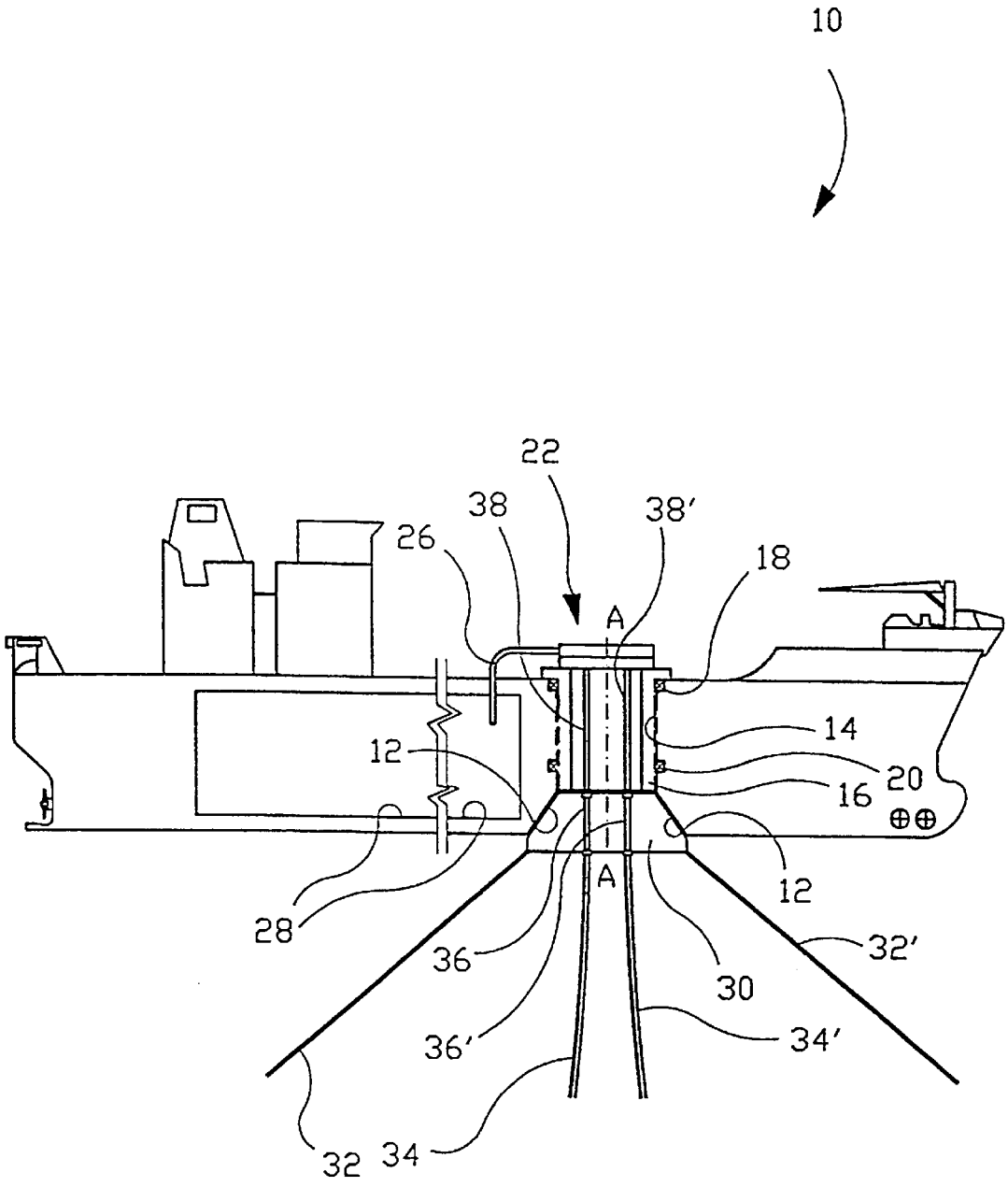
FIG. 3 shows a side view/vertical section corresponding to FIG. 2, but here the ship's own turret has been lowered into its connecting position with the underlying buoy.

As a test production ship 10, FIG. 1, the second turret 16 alone accordingly serves as the turret of the ship. In such cases the ship is held in position by means of so-called dynamic positioning:

Reference is now made to FIGS. 2 and 3 to illustrate the ship used as a production ship connected to a buoy.

The same ship 10, now working as a production ship in connection with the submerged buoy 30—the first turret—has not been submitted to modifications compared to the test production ship 10 according to FIG. 1.

In FIG. 2, in a manner not further defined, the second turret 16 has been lifted somewhat (by means of for example a wireline having a winch arranged thereto, which winch may be mounted in the not shown rig structure) so as to facilitate the reception of the buoy 30 in the complementary bottom recess 12 of the ship and subsequent connection to the turret 16.

The buoy 30 is kept submerged by means of sloping mooring hawsers 32, 32' which are anchored to the seabed. Two risers in the form of tubings 34, 34' emerge from a subsea well and correspond with through channels/bores 36, 36' to which the riser ends are connected in a known manner.

The second turret 16 is provided with corresponding and connectable channels/bores 38, 38', this connecting taking place when the second turret 16 according to FIG. 3 has been lowered into its working position.

With the second turret 16 in the lowered position shown in FIG. 3, the second turret 16 is rigidly connected to the first turret 30, so that the two turrets 30, 16 then appear as one turret 30,16 about whose vertical longitudinal axis A—A the ship 10 may pivot, depending on wind, sea and sea currents.

What is claimed is:

1. Device by ship (10) for enabling application of the ship both as production ship, in which it works together with a so-called STL-buoy (30), and as test production ship, in which it does not co-operate with such a buoy, and in which the ship (10) has a pit (14, 12) extending vertically therethrough, in which a turret (16) is pivotally supported having a vertical axis of rotation (A—A), and is to be connected, when the ship is used as production ship, to said buoy (30) which has a conical upward tapering upper portion, and in which the lower cavity portion (12) of the pit (14, 12) has an essentially complementary configuration to facilitate the insertion of the buoy (30) or its upper portion respectively, and subsequently the pivotal reception thereof, in the conical, lower cavity portion (12) of the pit (14, 12), characterized in that the turret (16) can be lifted/lowered in the upper portion (14) of the pit (14,12) and has a lower, working position in which its lower end is located immediately above said complementarily shaped, lower pit portion (12) for the buoy (30), and that the turret (16) at its upper end portion has an annular supporting flange (16') favouring and facilitating its pivotal mounting in relation to the ship's hull and does not interfere in the lifting/lowering of the turret, but is determinative for its lower, working position.

2. Device according to claim 1, characterized in that the annular supporting flange (16') on the turret (16) is supported in the ship's hull by means of an upper supporting device (18), preferably consisting of a combined axial/radial bearing and by underlying bearing devices (20) in the form of a radial bearing/radial bearings in a known manner.

* * * * *